US005340517A

United States Patent [19]

Koschinek et al.

[11] Patent Number: 5,340,517

[45] Date of Patent: Aug. 23, 1994

[54] PROCESS FOR PRODUCING SYNTHETIC FILAMENTS

[75] Inventors: Günter Koschinek, Dietzenbach; Dietmar Wandel, Hanau, both of Fed. Rep. of Germany

[73] Assignee: Zimmer Aktiengesellschaft, Frankfurt, Fed. Rep. of Germany

[21] Appl. No.: 73,170

[22] Filed: Jun. 7, 1993

[30] Foreign Application Priority Data

Jun. 25, 1992 [DE] Fed. Rep. of Germany ..... 4220915

[51] Int. Cl.[5] ..... B29C 35/16; D01D 5/12

[52] U.S. Cl. ..... 264/103; 264/211.12; 264/237; 425/72.2

[58] Field of Search ..... 264/103, 211.12, 211.14, 264/237; 425/72.2

[56] References Cited

U.S. PATENT DOCUMENTS

| | | | |
|---|---|---|---|
| 4,496,505 | 1/1985 | Tanji et al. | 264/101 |
| 4,529,368 | 7/1985 | Makansi | 425/72.2 |
| 4,712,988 | 12/1987 | Broaddus et al. | 425/72.2 |

FOREIGN PATENT DOCUMENTS

| | | | |
|---|---|---|---|
| 1914556 | 3/1970 | Fed. Rep. of Germany . | |
| 2117659 | 10/1972 | Fed. Rep. of Germany . | |
| 1220424 | 1/1971 | United Kingdom | 264/237 |

*Primary Examiner*—Leo B. Tentoni
*Attorney, Agent, or Firm*—Allegretti & Witcoff, Ltd.

[57] ABSTRACT

A process for producing spin-oriented filaments at a draw-off speed of more than 2400 m/min, whereby the filaments extruded from a spinneret are solidified in a cooling shaft solely by the ambient air entrained by the suction effect of the filaments and the cooling shaft having a zone where the walls are air permeable directly beneath the spinneret and has a following zone where the peripheral walls are completely closed.

4 Claims, 2 Drawing Sheets

PROCESS FOR PRODUCING SYNTHETIC FILAMENTS

BACKGROUND OF THE INVENTION

This invention concerns a process for spinning and cooling spin-oriented multifilaments by means of a spinning apparatus having spinning heads containing spinnerets and cooling shafts with an air-permeable wall through which a stream of air is sucked into the interior of the cooling shaft solely by the frictional entrainment of air by the filaments.

Multifilament continuous filaments of synthetic polymers are produced from a melt at the spinning temperature by means of a spinning device. The melt is forced through boreholes in a spinneret. The resulting melt streams are then cooled and combined to form a filament bundle, which is treated with a spin finish oil, then drawn off with a fiber draw-off device and finally wound onto tubes to form a bobbin.

Cooling is especially important here. The uniformity of cooling has a direct influence on the physical characteristics of the filaments such as uniformity of the Uster-value or dyeing receptivity. Trouble is caused by non-laminar or turbulent flow of the cooling air. Before the melt streams which are extruded at a high spinning temperature have cooled below the solidification point, contact with each other or with the thread guides has to be avoided because they would stick.

PRIOR ART

Systems with cool air processing in a climate-controlled installation and feeding of the air through air ducts to cooling shafts and blowing the air by means of fans into the area of the melt streams below the spinnerets have proven successful. However, complicated air distribution systems, controls and homogenization equipment must be used in order to guide the turbulent cooling air and maintain laminar flow.

Practical examples of these systems include those with cross flow, i.e., essentially air flow at right angles to the filaments and direct removal of the heat of melting on the leeward side (U.S. Pat. No. 4,529,368) as well as those with radial flow, i.e., air is directed from the outside into the filament bundle and heat is dissipated essentially in the direction of travel of the filament (U.S. Pat. No. 4,712,988 and German Patent A 3,406,347).

Another method of producing a stream of cooling air consists of passing the filaments through a suction device where the stream of cooling air is produced by the reduced pressure (U.S. Pat. No. 4,496,505 and International Patent WO 90-02222A).

Conventional currently-used techniques for cooling the melt streams in order to combine them into a filament bundle and process them further consist of blowing air onto them either by means of forced air pressure or reduced pressure.

German Patent A 1,914,556 discloses a device for spinning and cooling synthetic continuous filaments whereby the required stream of cooling air is created inside a shaft provided with a number of perforations and through which shaft a bundle of melt streams extruded from a spinneret is guided. The shaft consists exclusively of an air barrier shaft without perforations for a length of 300 to 500 mm just down stream of the spinning head. In the next stage it consists of a shaft with flow control and with ventilation openings for the remaining total length. The short unperforated zone at the lower end of the shaft shown in FIG. 5 is not mentioned anywhere in the patent specification and could serve only to provide mechanical stability for the cooling shaft. Because the portion of the shaft next to the spinning head is imperforate, access of outside air into this region of the shaft is completely prevented. The melt streams thus are not be subjected to any cooling at all immediately after leaving the spinning head. The result is a lengthening of the required cooling zone accordingly, for example, to about 2000 mm.

THE INVENTION

The object of this invention is to provide a process for spinning and cooling synthetic continuous filaments that will not require much energy consumption, will require minimal equipment and control technology, and will be especially suitable for high draw-off speeds. This object is achieved by sucking the air stream directly into the cooling shaft directly below the spinnerets solely by the frictional entrainment of the air by the filaments, where the walls of the cooling shaft are subdivided into two different zones in the longitudinal direction and the filaments are drawn off at speeds of at least 2400 m/min. The wall of the first zone directly below the spinneret is air permeable and the wall of the second following zone is closed or imperforate.

In a departure from the teachings of German Patent DE A 1,914,556 cited above, cooling air derived from outside ambient air is provided for the melt streams directly beneath the spinnerets. This cooling air is sucked into the shaft because of the friction between the air and the filaments being guided through the respective zones of the cooling shaft. To a certain extent this is comparable to an injector effect. This entrainment effect extends along the entire length of the cooling shaft and includes the area directly beneath the spinnerets so the melt streams to be cooled are subjected to cooling immediately after they leave the spinneret. Subdividing the cooling shaft into two zones results in a channelizing effect on the air stream along the direction of the filaments such that air is sucked in through the perforated wall of the shaft and supplied into the directed stream along the length of the first zone. A convective exchange of heat and flow through the walls is suppressed along the length of the second zone.

It has surprisingly been found that especially at high draw-off speeds a cooling effect created by the injector action described above produces filaments having a spin orientation in part because of the high draw-off speed. This orientation cannot be obtained when using the device according to German Patent A 1,914,556 because of the relatively low draw-off speed of 1000 m/min preferred in that device. Secondly, the filaments have a uniformity which cannot be achieved when using the device according to German Patent A 1,914,556 even in combination with a draw-off speed of more than 2400 m/min. The uniform cooling in the area directly beneath the spinnerets which is obtained according to the present invention, results in filaments having a high uniformity along their entire length as well as between one monofilament and the next. Especially when using draw-off speeds of more than 4500 m/min. there is less trouble in the spinning process-in other words, there was a lower incidence of breakage of single filaments due to the disturbance in drawing off the filaments. Preventing convective heat exchange and flow exchange through the walls of the second zone also acts as a buffer against external interference, causes an alignment of the air flow in the direction of the filaments and delays the subsequent cooling effect. In this zone the filaments are already highly drawn and already have a velocity close to the draw-off speed. The interaction of these two conditions evidently yields conditions that are otherwise achieved only by actively supplying heat from the outside, for example, with the help of a heated spinning shaft as described in German Patent A 2,117,659.

Furthermore, this process yields an important practical advantage compared with traditional cooling systems, where cooling air is directed against the filaments by means of excess pressure or a reduced pressure. Those systems require a considerable technical expense, especially for fans, which expense is completely eliminated with the present invention. The process according to this invention makes it possible to produce superior filaments in a practical and advantageous manner at greatly reduced cost. It is possible to eliminate separate climate control installations which consume a great deal of energy in processing cooling air, also the use of air ducts and homogenization equipment to create a laminar flow of the turbulent air as well as heating equipment for after treatment of the thread.

When using the process according to this invention, the average distance between the single filaments in a filament bundle on leaving the cooling shaft can be less than 6 mm because of the particularly high uniformity of the air flow and the rapid cooling of the filaments. Preferably a bundle filament guide that combines the filaments to form a thread is installed directly at the outlet of the cooling shaft. This permits a short spinning length which in turn permits a low thread tension when using a high draw-off speed and also permits an advantageous design of the spinning apparatus.

Favorably, the process according to this invention is suitable for producing single filament titers of 0.3 to 3.0 dtex at a draw-off speed of 2400 to 8000 m/min.

The device for carrying out the process according to this invention is designed so that the cooling shafts are connected directly at the lower end of the spinning heads, the walls of the cooling shafts are provided with perforations to permit access of air over the length of the first zone and the second zone is designed with imperforate walls.

The air permeable walls can be formed of a metal mesh or with small holes or perforations.

The length of the cooling shaft is at least 200 mm and normally is a maximum of 1500 mm. The length of the second zone ranges from somewhat shorter than the first zone to approximately twice the length of the first zone. Preferably, the length of the second zone is approximately 80% to 200% of the length of the first zone.

Preferably the device is designed in such a way that the cooling shaft has two telescoping sections that can move relative to each other in the longitudinal direction. One section is perforated and forms the first zone, whereas the other section is imperforate. By simply sliding one section with respect to the other, the length ratio of the two zones and the total length can be adjusted easily. The cross-sectional shape of the cooling shaft depends on the shape of the spinnerets which may be round, oval or rectangular. Accordingly the cooling shaft may have a circular, oval or rectangular cross section which is preferably 10 to 60 mm larger than the cross section of the orifice field of the spinneret. When using circular spinnerets, the cooling shaft and its walls are designed so they are cylindrical and surround the filament bundle concentrically.

BRIEF DESCRIPTION OF THE DRAWING

There is shown in the attached drawing a presently preferred embodiment of the invention, wherein.

DETAILED DESCRIPTION OF THE PRESENT INVENTION

Figure 1:
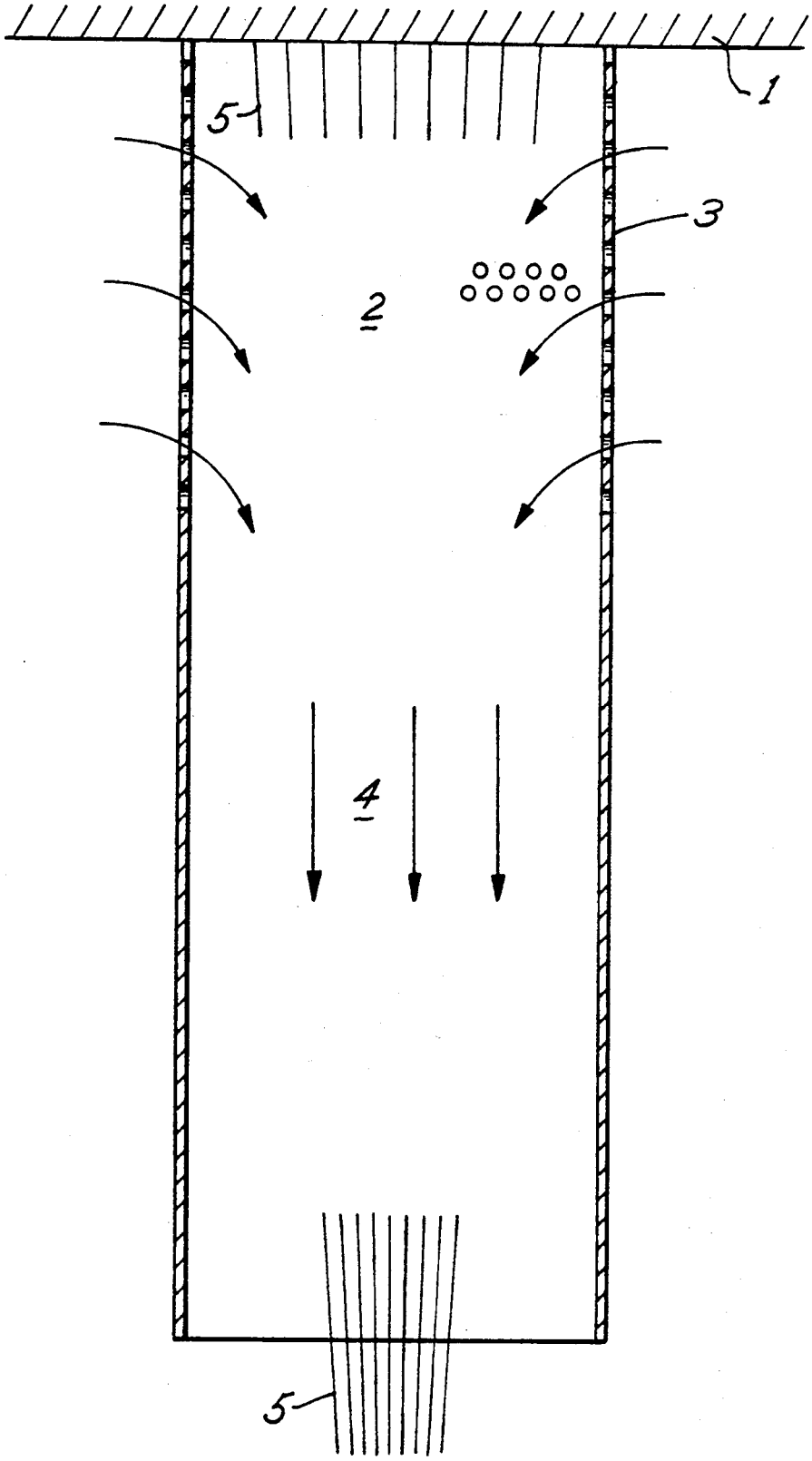
FIG. 1 is a schematic cross sectional view of a cooling shaft extending from a spinning head.

Although a commercial spinning apparatus has multiple spinning heads, the drawing illustrates only a single head and a single cooling shaft.

FIG. 1 shows in schematic form an example of a cooling shaft extending from the lower side 1 of the spinning head and concentrically surrounds the filaments 5 leaving the spinneret. The shaft is essentially a metal cylinder 3.

Metal cylinder 3 has holes or perforations distributed uniformly over the walls of the first zone 2, whereby the air permeability can be varied over a wide range. However, the air resistance should not be so great as to impair the suction effect. Excessively large perforations should also be avoided in order to buffer the movement of air in the vicinity. A perforated, open area which comprises a maximum of 50% of the total surface area of the wall has proven appropriate.

Since each filament bundle is surrounded by the cylinder wall 3 of the cooling shaft, the cooling air drawn in through the suction effect of the moving filaments (note the arrows in FIG. 1) is directed essentially radially from the outside to the inside. It is drawn from the environment and therefore has a temperature corresponding to the temperature of the spinning area.

The walls surrounding the second zone 4 are closed or imperforate so that air can flow through the zone only from the filament inlet end to the outlet end of the shaft.

Below the cooling shaft, there is a thread oiling device (not shown) or some other type of thread guide for bundling the solidified filaments to form a thread which is then guided to a draw-off device and wound onto tubes to form a bobbin.

Figure 2:
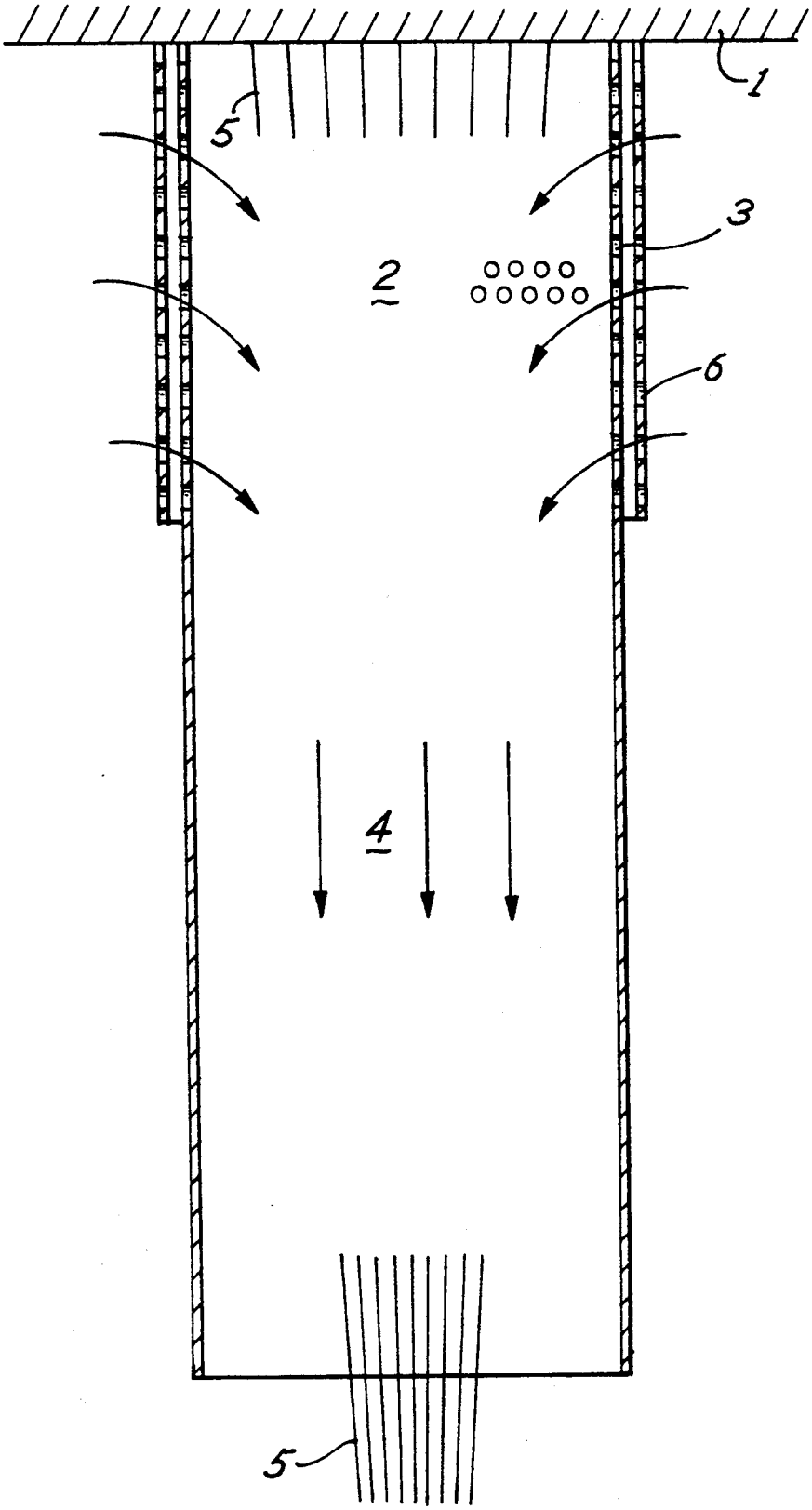
FIG. 2 is a schematic cross sectional view of a modified cooling shaft extending from a spinning head.

The cooling shaft shown schematically in FIG. 2 has a design similar to that in FIG. 1. A second perforated metal cylinder 6 is arranged concentric with the first cylinder 3 and is spaced from it in the area of the air permeable walls of the first zone. This construction provides an additional buffering effect for air movements in the spinning area—for example, in opening and closing doors. A maximum wall distance of 20 mm between the two perforated metal cylinders is recommended.

EXAMPLE 1

Polyethylene terephthalate (PET) chips with an intrinsic viscosity (I.V.) of 0.63 dl/g were melted, and the melt was extruded through the orifices or nozzles of a spinneret at a temperature of 294° C. The spinneret had a diameter of 80 mm. The orifice field diameter was 70 mm and the diameter of each orifice was 0.25 mm, the length L=2 D. The number of orifices in the spinneret was 34.

The polymer delivery rate was 39.5 g/min, thus yielding a titer of 76f34 dtex, corresponding to a spinning titer of 2.24 dtex per single filament.

Directly beneath the spinneret there was a cooling shaft in the form of a metal cylinder with a diameter of 100 mm. The length of the first zone was 500 mm and it was perforated. The diameter of each hole was 5 mm. The holes (2730 holes) were distributed uniformly over the wall. The open area amounted to 34%. The length of the second zone was 500 mm and the zone was designed with closed walls.

The cooling shaft was surrounded by ambient air at a temperature of 29° C. The filaments were bundled in a filament thread oiler 100 mm from the cooling cylinder.

Then the filament bundle was drawn off at a speed of 5200 m/min by a bobbin winder equipped for compensation of tension by means of a grooved roller operated with an overfeed of 6%.

The thread characteristics and uniformity values were as follows:

| | |
|---|---|
| Titer (dtex) | 76.1 |
| Breaking Load (cN) | 256.6 |
| CV Breaking Load (%) | 1.8 |
| Tenacity at Break (cN/tex) | 33.7 |
| Elongation at Break (%) | 62.8 |
| CV Elongation (%)* | 3.0 |
| Uster Half Inert (%) | 0.32 |
| Single Filament CV Titer (%) | 3.1 |

*(CV = Coefficient of Variation)

EXAMPLES 2 AND 3

The procedure followed was the same as described in Example 1, but the delivery rate was increased slightly to 42.5 g/min. In addition, the length of the second zone was shortened to 150 mm in one case (Example 2) while in the other case (Example 3) this zone was lengthened to 800 mm.

The individual characteristics of the POY (Partially Oriented Yarn) were as follows:

| | Example 2 | Example 3 |
|---|---|---|
| Titer (dtex) | 82.6 | 82.5 |
| Breaking Load (cN) | 265.0 | 288.9 |
| CV Breaking Load (%) | 3.2 | 1.8 |
| Tenacity at Break (cN/tex) | 32.1 | 35.0 |
| Elongation at Break (%) | 59.9 | 66.6 |
| CV Elongation (%) | 4.7 | 3.5 |
| Uster Half Inert (%) | 0.7 | 0.34 |

With the greatly shortened length of the second cooling zone according to Example 2, the values obtained for product uniformity are inferior to those of Example 1.

With the greatest length according to Example 3, the highest values for tenacity and elongation are obtained, which is equivalent to a good resistance of the yarn to stress.

EXAMPLE 4

The procedure and equipment were the same as in Example 1 but the delivery was reduced to 34.9 g/min.

At the same time the draw-off speed was reduced to 4200 m/min so the titer of the wound thread was approximately the same as that in Examples 2 and 3.

Even at this speed, a uniform quality of the product could be achieved.

The fiber characteristics and uniformity data were as follows:

| | |
|---|---|
| Titer (dtex) | 83.3 |
| Breaking Load (cN) | 260.0 |
| CV Breaking Load (%) | 2.1 |
| Tenacity at Break (cN/tex) | 31.2 |
| Elongation at Break (%) | 87.1 |
| CV Elongation (%) | 3.6 |
| Uster Half Inert (%) | 0.31 |

The product of tenacity times the square root of elongation equals 291. This is of the same order of magnitude as the product in Example 3.

We claim:

1. A method for producing spin oriented filaments comprising providing a spinning head connecting directly to a cooling shaft having perforated walls immediately adjacent said head, defining a first zone, and imperforate walls spaced from said head defining a second zone adjacent said first zone, extruding filaments from said head into said shaft, cooling said filaments in said first zone by ambient air drawn into said shaft through said perforations solely by the frictional entrainment of the air by said filaments, and drawing said cooled filaments at a velocity in excess of 2400 m/min to orient said filaments in said second zone solely in the presence of entrained air from said first zone flowing along the length and in the direction of the moving filaments.

2. The process according to claim 1, in which said filaments leaving said second zone are bundled, drawn off and wound on a bobbin.

3. The process of claim 1, in which the length of said second zone is within the range of about 80% to 200% of the length of said first zone.

4. The process of claim 1, in which said velocity exceeds 4500 m/min and said spin oriented filaments have a titer value of 0.3 to 3.0 dtex.

* * * * *